US010781674B2

(12) United States Patent
Bourgneuf et al.

(10) Patent No.: US 10,781,674 B2
(45) Date of Patent: Sep. 22, 2020

(54) LINER CONVEYED COMPLIANT SCREEN SYSTEM

(71) Applicant: Halliburton Energy Services, Inc., Houston, TX (US)

(72) Inventors: Patrick Patchi Bourgneuf, Pau (FR); Maxime Philippe Coffin, Carrolton, TX (US); Andrew David Penno, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 16/097,767

(22) PCT Filed: Mar. 5, 2018

(86) PCT No.: PCT/US2018/020955
§ 371 (c)(1),
(2) Date: Oct. 30, 2018

(87) PCT Pub. No.: WO2018/165043
PCT Pub. Date: Sep. 13, 2018

(65) Prior Publication Data

US 2019/0153825 A1 May 23, 2019

Related U.S. Application Data

(60) Provisional application No. 62/467,298, filed on Mar. 6, 2017.

(51) Int. Cl.
*E21B 43/10* (2006.01)
*E21B 43/25* (2006.01)
(Continued)

(52) U.S. Cl.
CPC ..... *E21B 43/108* (2013.01); *E21B 33/12* (2013.01); *E21B 33/14* (2013.01); *E21B 33/146* (2013.01);
(Continued)

(58) Field of Classification Search
CPC ..... E21B 43/108; E21B 33/12; E21B 33/14; E21B 33/146; E21B 33/16; E21B 43/10; E21B 43/25; E21B 43/26
See application file for complete search history.

(56) References Cited

U.S. PATENT DOCUMENTS 5,746,274 A 5/1998 Voll et al.
6,543,545 B1 * 4/2003 Chatterji ..... E21B 43/04 166/207
(Continued)

FOREIGN PATENT DOCUMENTS

WO 2006041825 A2 4/2006
WO 2006041825 A3 6/2006
(Continued)

OTHER PUBLICATIONS

International Searching Authority, Patent Cooperation Treaty, International Search Report and Written Opinion, International Application No. PCT/US2018/020941, which is a PCT parent to the instant application, dated Jun. 22, 2018.
(Continued)

*Primary Examiner* — Crystal J Miller
(74) *Attorney, Agent, or Firm* — Scott Richardson; Parker Justiss, P.C.

(57) ABSTRACT

A well completion assembly and method including apparatus for setting a compliant screen assembly and a liner within a wellbore in a single trip.

20 Claims, 15 Drawing Sheets

(51) Int. Cl.

| | |
|---|---|
| ***E21B 33/14*** | (2006.01) |
| ***E21B 33/16*** | (2006.01) |
| ***E21B 33/12*** | (2006.01) |
| ***E21B 43/26*** | (2006.01) |

(52) U.S. Cl.
CPC ..... *E21B 33/16* (2013.01); *E21B 43/10* (2013.01); *E21B 43/25* (2013.01); *E21B 43/26* (2013.01)

(56) References Cited

U.S. PATENT DOCUMENTS

| | | | | |
|---|---|---|---|---|
| 6,729,393 | B2 | 5/2004 | Vincent et al. | |
| 7,337,840 | B2 | 3/2008 | Penno | |
| 8,479,810 | B2 | 7/2013 | Metcalfe | |
| 2003/0085037 | A1 | 5/2003 | Roane et al. | |
| 2006/0076133 | A1 | 4/2006 | Penno | |
| 2008/0110620 | A1 * | 5/2008 | Penno | E21B 43/045 166/278 |
| 2013/0000899 | A1 | 1/2013 | Broussard et al. | |
| 2014/0251609 | A1 * | 9/2014 | Broussard | E21B 43/04 166/278 |

FOREIGN PATENT DOCUMENTS

| | | | | |
|---|---|---|---|---|
| WO | 2012066290 | A2 | 5/2012 | |
| WO | WO-2012066290 | A2 * | 5/2012 | E21B 43/04 |

OTHER PUBLICATIONS

International Searching Authority, Patent Cooperation Treaty, International Search Report and Written Opinion, International Application No. PCT/US2018/020955, which is a PCT parent to the instant application, dated Jun. 21, 2018.

Halliburton, Solving Challenges, Liner-Conveyed Gravel Pack (LCGP) System, 2015.

* cited by examiner

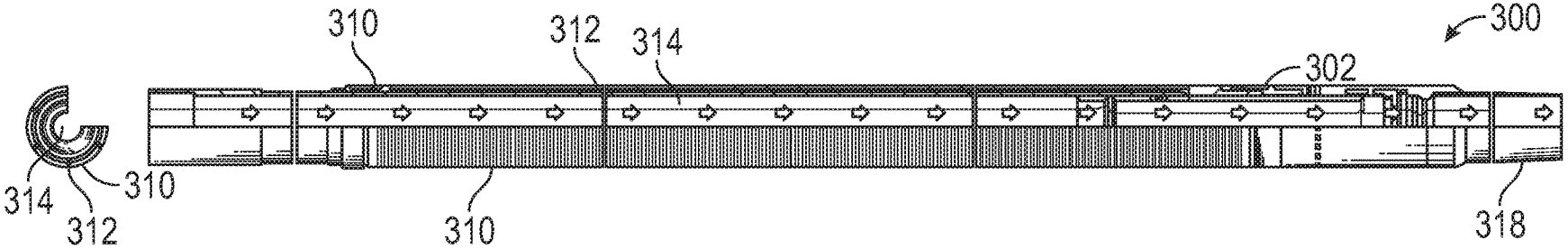
FIG. 11A
FIG. 11B
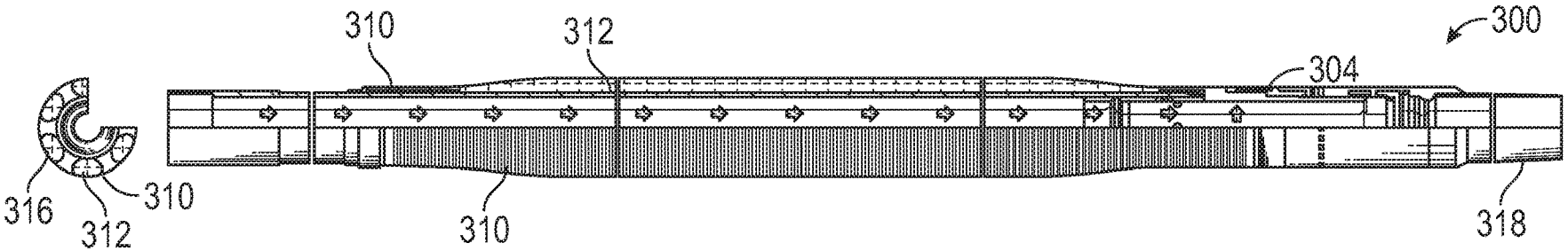
FIG. 11C
FIG. 11D
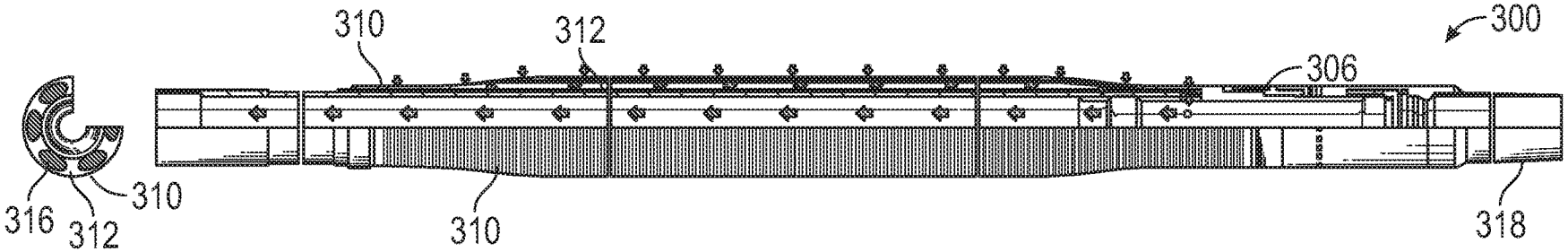
FIG. 11E
FIG. 11F

LINER CONVEYED COMPLIANT SCREEN SYSTEM

BACKGROUND

Hydrocarbon producing wells are often completed in unconsolidated producing formations containing fines and sand that can flow with produced hydrocarbons (fluids or gas) from the formations. The solid particulates in the produced fluids flow stream can damage equipment and must be removed from the produced fluids. Following drilling of a wellbore through an unconsolidated formation it is often a requirement that the wellbore be completed with a device that retains the sand particles in the formation, but that allows the flow of fluids to be produced. Filters, such as for example, sand screens or compliant screens, are commonly installed in wellbores and a gravel pack operation or the conformance of the screen against the borehole geometry can be performed to assist with the filtering out the fines and sand in the produced fluids and in the stabilizing of the producing formation.

The portion of the well above the productive formation is usually lined with one or more steel casing. The annulus between the casing and the wellbore is typically filled with cement to stabilize the casing and prevent fluid flows within the annulus. The wellbore can then be drilled further to drill through the productive formation. A length of blank pipe may be run to provide a second casing (often referred to as a liner) in the wellbore below the existing casing to a location just above the productive formation. At least a portion of the annulus between the liner and the open hole below the casing is normally filled with cement to hold the liner in place and block annular flow of fluids around the liner. A screen assembly can then be run below the liner into the open hole zone to provide a flow path for produced fluids from the producing formation, through the screen and liner and to the cased portion of the well. A flow conduit for produced fluids within the cased portion of the well to the surface is typically a production tubing string.

A well completion in an open hole zone generally requires both a sand control operation and a cementing operation. These operations have typically been performed using separate stages and multiple sets of equipment run into the well at different times. For example, a liner may be placed in the well and a cementing assembly may be run into the well to perform cementing of the liner. Once cementing of the liner is completed the cementing assembly is typically removed from the well and a sand control assembly run into the well. Thus, multiple trips into the well have typically been required to place the liner and the screen within the well and to cement the liner. Each trip into the well to position equipment or perform an operation requires additional time and expense and presents a challenge.

BRIEF DESCRIPTION OF THE DRAWINGS

FIGS. 11*a* through 11*f* illustrate cross-sectional and sectional views of a compliant screen assembly according to an embodiment, at its Run-in state, Activation state, and Productive state in accordance with certain embodiments of the present disclosure.

DETAILED DESCRIPTION

Figure 1:
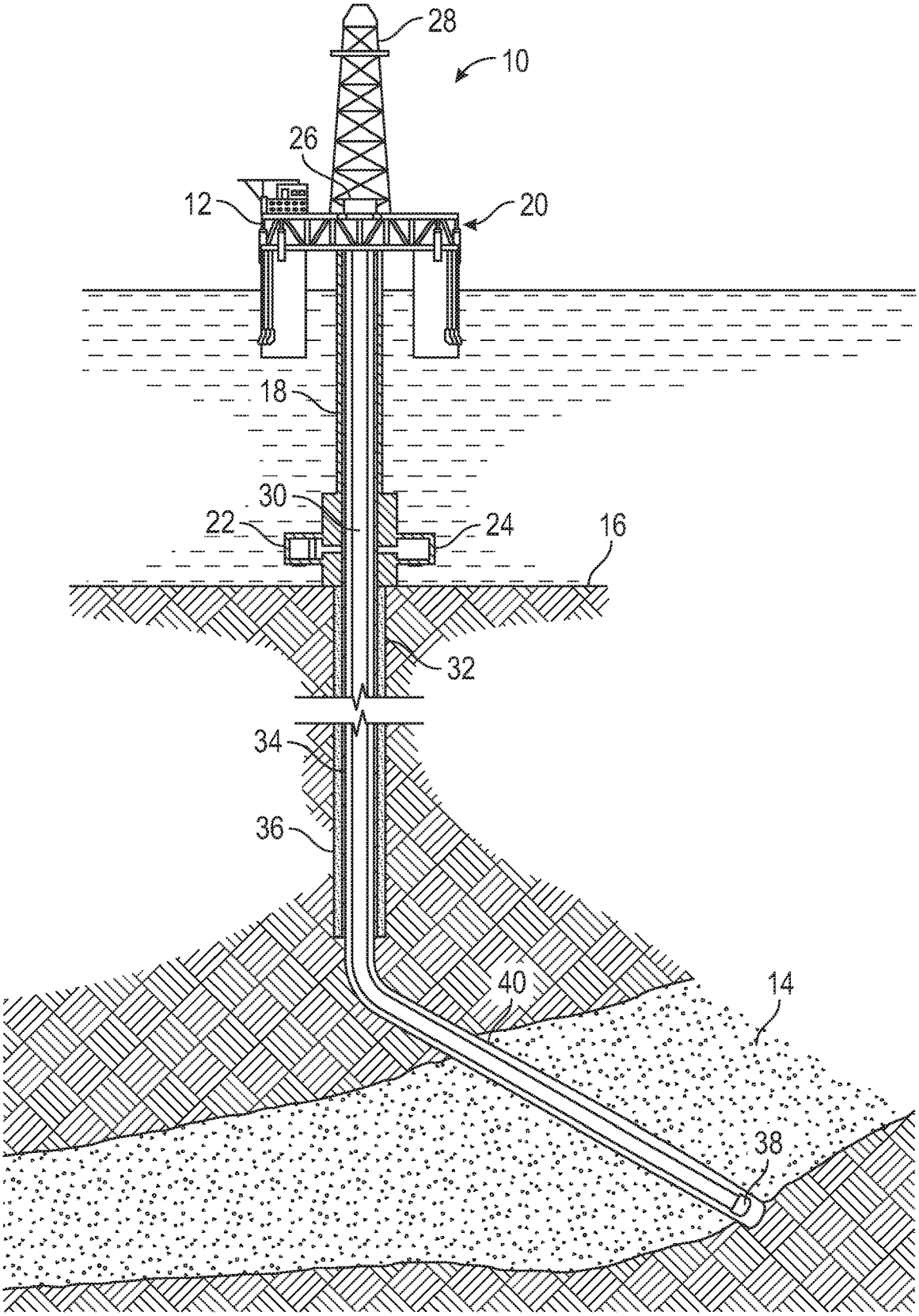
FIG. 1 is a schematic illustration of an offshore oil and gas platform and the drilling of a wellbore through a subterranean formation.

The following detailed description illustrates embodiments of the present disclosure. These embodiments are described in sufficient detail to enable a person of ordinary skill in the art to practice these embodiments without undue experimentation. It should be understood, however, that the embodiments and examples described herein are given by way of illustration only, and not by way of limitation. Various substitutions, modifications, additions, and rearrangements may be made that remain potential applications of the disclosed techniques. Therefore, the description that follows is not to be taken as limiting on the scope or applications of the appended claims. In particular, an element associated with a particular embodiment should not be limited to association with that particular embodiment but should be assumed to be capable of association with any embodiment discussed herein.

Various elements of the embodiments are described with reference to their normal positions when used in a borehole. For example, a screen may be described as being below or downhole from a crossover. For vertical wells, the screen will actually be located below the crossover. For horizontal wells, the screen will be horizontally displaced from the crossover, but will be farther from the surface location of the well as measured through the well. Downhole or below as used herein refers to a position in a well farther from the surface location in the well.

An annulus, as used in the embodiments, is generally a space between two generally cylindrical elements formed when a first generally cylindrical element is positioned inside a second generally cylindrical element. For example, a liner is a cylindrical element which may be positioned in a wellbore, the wall of which is generally cylindrical forming an annulus between the liner and the wellbore. While drawings of such arrangements typically show the inner element centrally positioned in the second, it should be understood that inner element may be offset and may actually contact a surface of the outer element at some radial location, e.g. on the lower side of a horizontal well. The width of an annulus is therefore typically not the same in all radial directions.

Cementing operations in a well and equipment used for such operations are generally well known in the well completion field. In general, the equipment provides a flow path through which cement may be flowed from a work string into an annulus between a casing, liner, or other oilfield tubular element and a well. Since the well is normally filled with a fluid, e.g. drilling fluid, completion fluid, etc., the equipment also includes a return flow path for fluid displaced by cement during the cementing operation.

Sand Control operations in a well and equipment used for such operations are also generally well known in the well completion field. A complete sand control assembly may be considered to include a screen or other filter element and length of blank pipe extending from the screen, both of which are to be installed in a well, as well as equipment for placing a gravel pack activate compliant screen and/or perform a fluid displacement/treatment around the screen in the well. The equipment typically includes a work string having a packer and cross over assembly and a wash pipe extending below the cross over to the bottom of the screen. When properly positioned for a sand control operation, the packer seals the annulus between the work string and the well above the screen. A fluid, i.e mud cake breaker, acid, brine . . . is then flowed down the work string to the crossover which directs the fluids into the annulus below the packer. The fluid flows through the screen into the wash pipe back up to the crossover which directs the return flow into the annulus above the packer. Alternatively, the fluid can be pumped down the annulus through the return port bypassing the crossover, down the washpipe. It will then flow along the open hole through the crossover and up the workstring. By plugging the bottom of the compliant screen, the screen can be activated by pressurizing in the same flow path than previously described. A packer may be used between the work string and the casing, liner, etc. to prevent cement from entering the annulus between the work string and the casing, liner, etc.

A well completion in an open hole zone generally requires the running of a liner, a cementing operation, the running of a screen, and a sand control operation. These completion operations are well known but are typically performed using multiple sets of equipment run into the well at different times. For example, a liner may be placed in the well and a cementing assembly may be run into the well to perform cementing of the liner. Once cementing of the liner is completed the work string with the cementing assembly is typically removed from the well and screens run into the well. Thus, multiple trips into the well have typically been required to place the liner and the screen within the well and to cement the liner and activate the compliant screen. Each trip into the well to position equipment or perform an operation requires additional time and expense. Further the screen assembly will need to have a smaller diameter to enable it to be run through the liner, which can lead to a restriction on the productive capacity of the well and induce constraints on future intervention operations.

The one trip liner conveyed screen system of the present disclosure provides an apparatus for selectively providing flow paths through a single work string for screen positioning and screen setting, liner placement and cementing, circulation paths for cleaning and, if desired, activating annular barriers. The flow path selection can be provided by sliding seals, sleeves, or ports formed between the work string and the liner/screen assembly. The selection of the flow path can be made by lifting and lowering the work string relative to the liner/screen assembly and/or by varying the fluid pressure within the work string. The movement of the work string relative to the liner/screen assembly can be performed at the surface location of the well by lifting and lowering the work string. Alternate means for selecting flow paths can also be used. The one trip liner conveyed screen system of the present disclosure provides for the screen to have a larger diameter than a screen assembly that is required if it were to be run through the liner.

FIG. 1 is a schematic illustration of an offshore oil and gas platform and the drilling of a wellbore through an oil and gas formation and is generally designated 10. A semi-submersible platform 12 is located over a submerged hydrocarbon formation 14 located below the sea floor 16. A subsea conduit 18 extends from the deck 20 of platform 12 to a wellhead installation 22 that includes blowout preventers 24. Platform 12 has a hoisting apparatus 26 and a derrick 28 for raising and lowering pipe strings, such as a substantially tubular, longitudinally extending drill string or work string.

Although FIG. 1 depicts an offshore slanted well from a semi-submersible platform, it should be understood that the open hole completion operations of the present disclosure are equally well-suited for use on onshore wells or alternative type offshore wells, in vertical wells, horizontal wells, multilateral wells and the like.

A wellbore 32 extends through the various earth strata including formation 14. A casing 34 is shown cemented within a vertical section of wellbore 32 by cement 36. A drill string 30 extends from the deck 20 of platform 12, through the wellhead installation 22, including blowout preventers 24, and has a drill bit 38 on the distal end. The open hole section 40 extends the wellbore 32 below the casing 34 and through formation 14.

Figure 2:
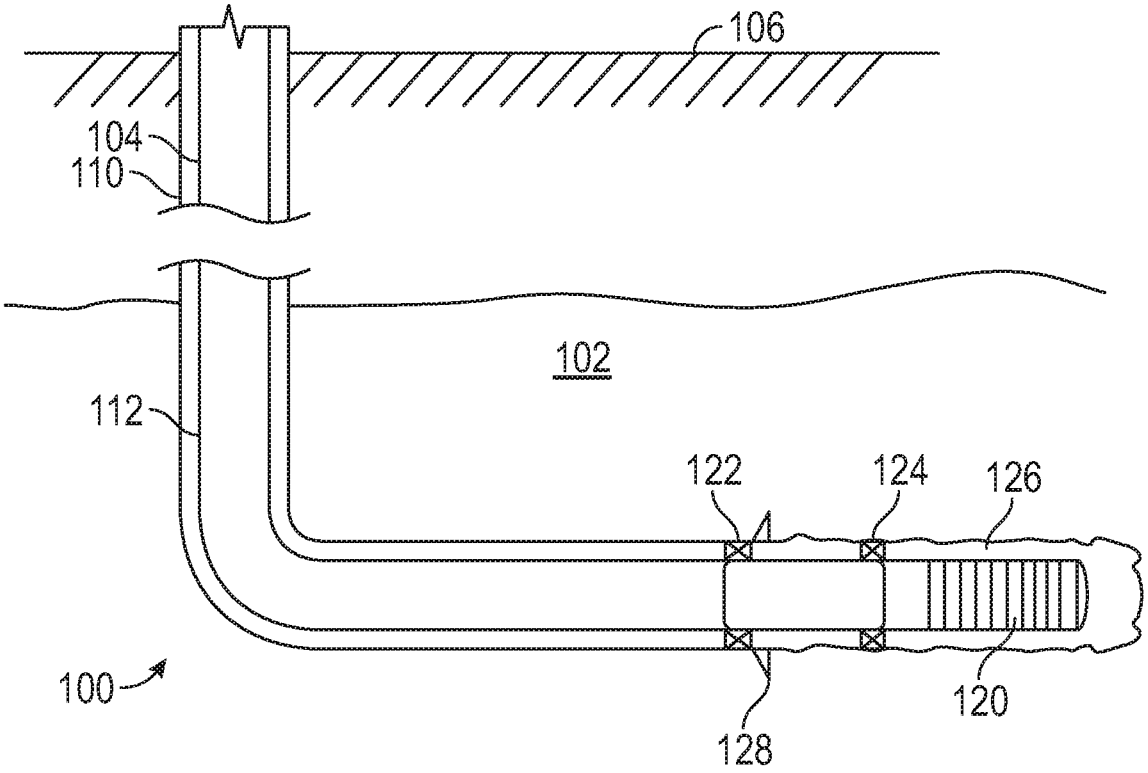
FIG. 2 is an elevation view of a cross-section of an example of a subterranean formation and drilling/completion/workover rig in which a sand control operation may be performed in accordance with certain embodiments of the present disclosure.
Figure 3A:
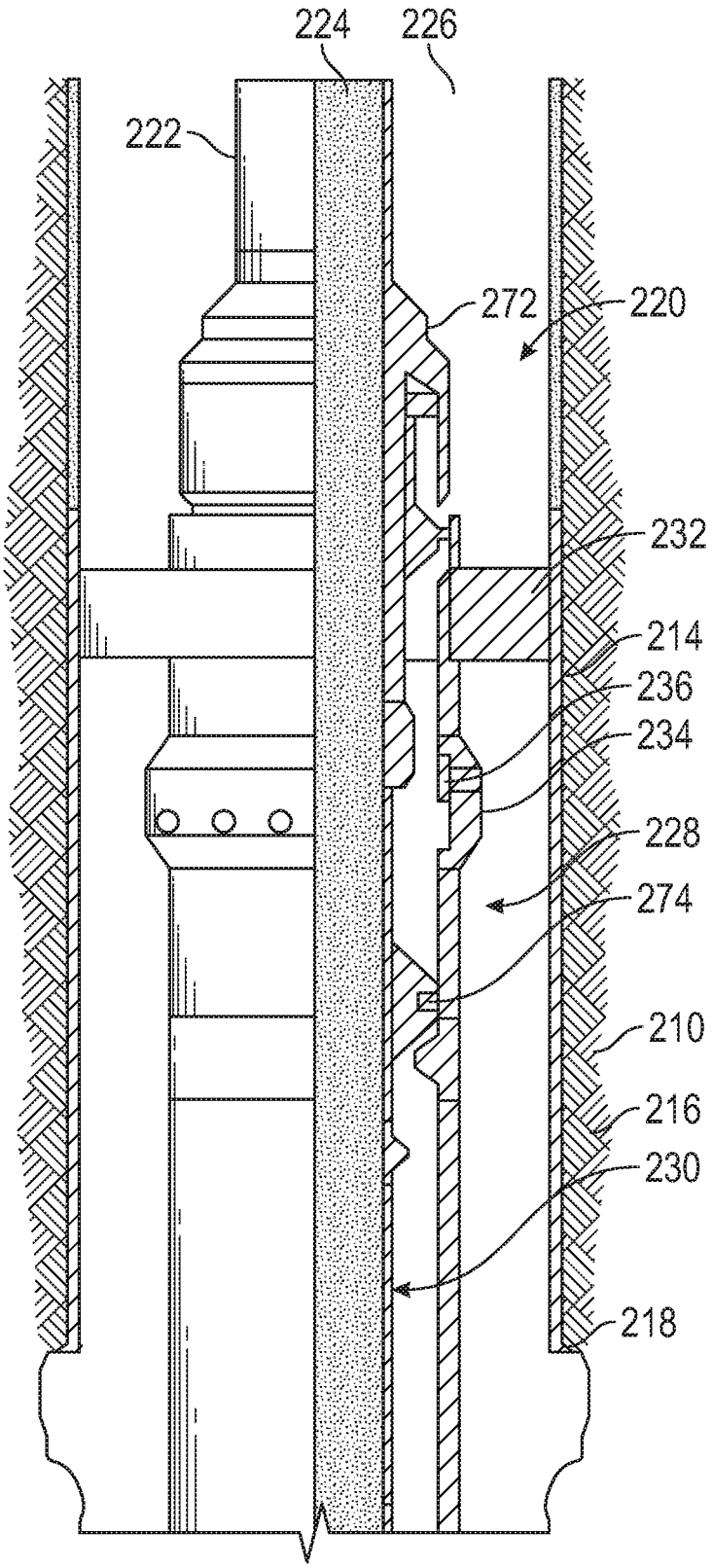
FIGS. 3*a*-3*d* illustrate an elevation sectional view of an assembly according to an embodiment, as positioned in a well in preparation for sand control operation and cementing in accordance with certain embodiments of the present disclosure.
Figure 3B:
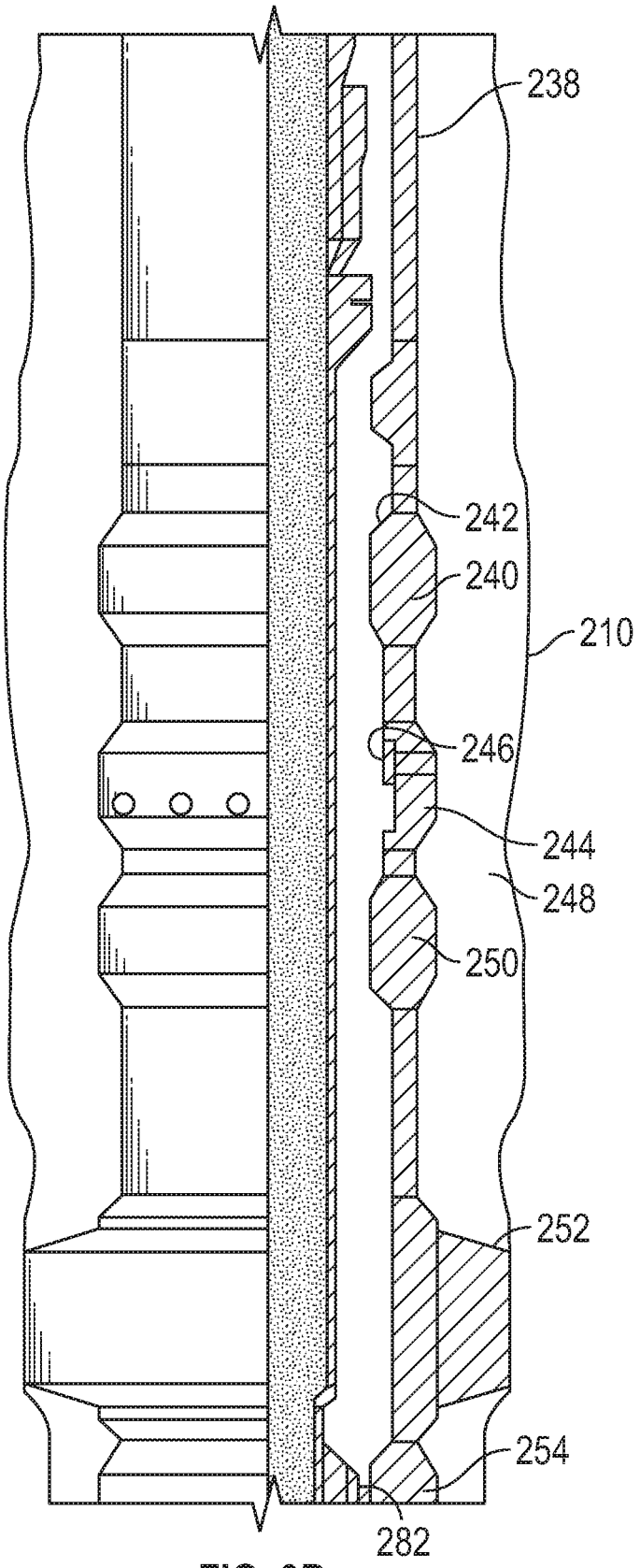
Figure 3C:
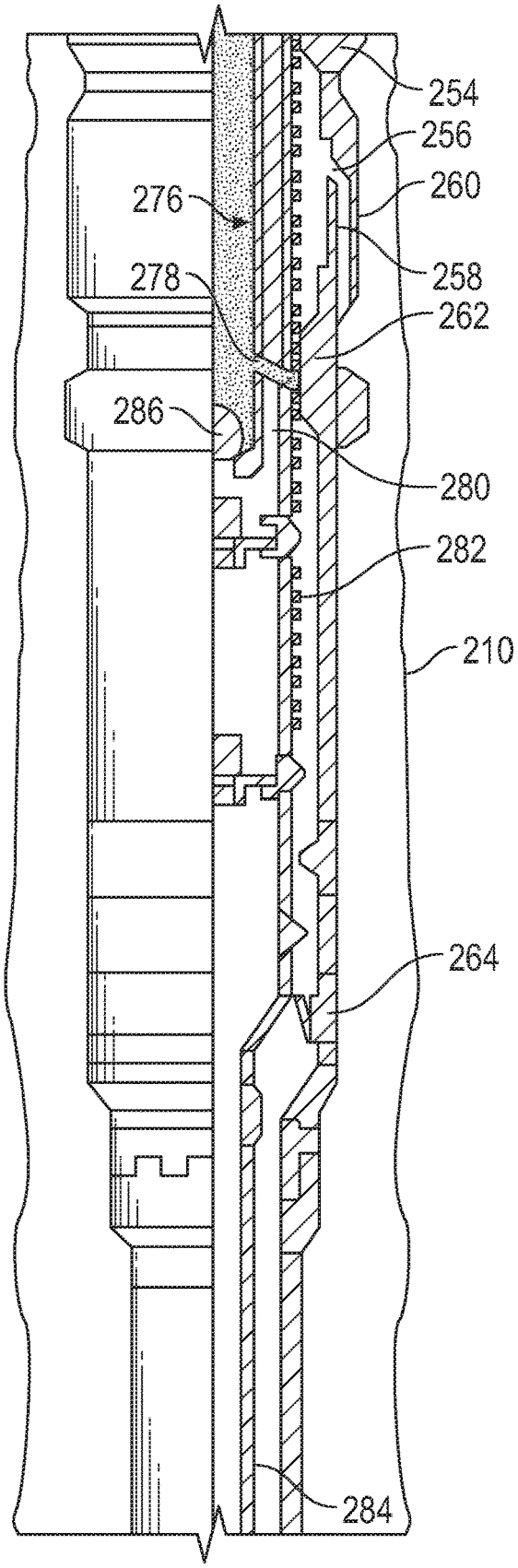
Figure 3D:
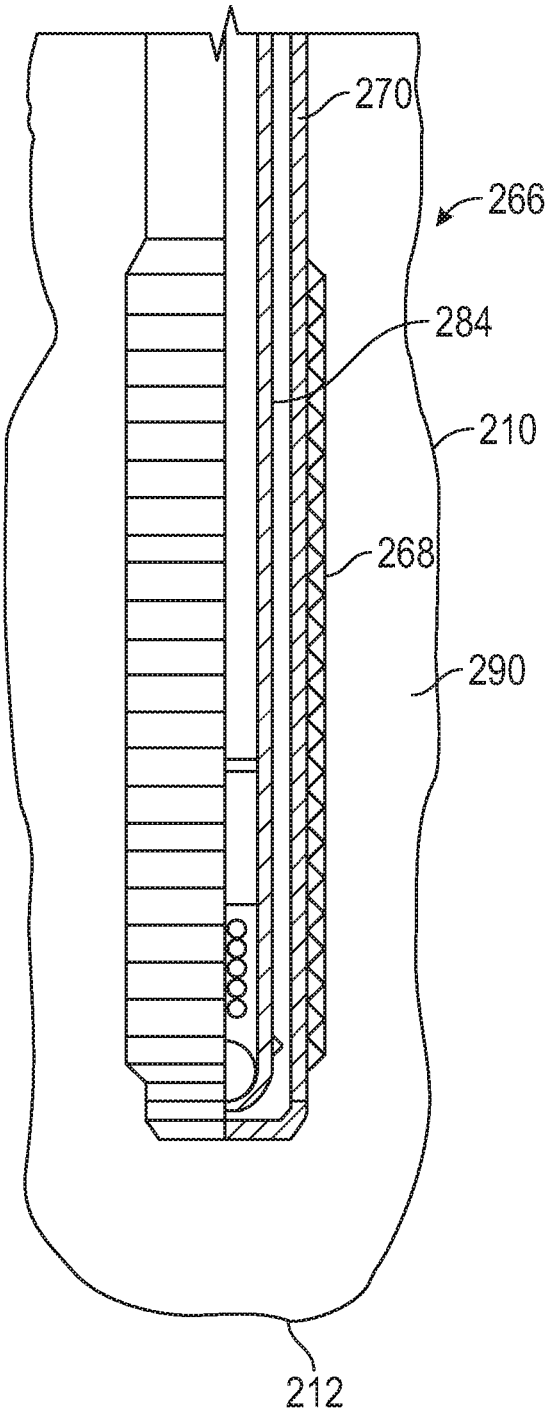

FIG. 2 is an elevation view of a cross-section of an example of a subterranean formation and drilling, completion or workover rig in which a sand control operation may be performed in accordance with certain embodiments of the present disclosure. FIG. 2 shows a well 100 during a sand control operation adjacent a portion of a subterranean formation of interest 102 surrounding a well bore 104. The well bore 104 extends from the surface 106. Although shown as vertical deviating to horizontal, the well bore 104 may include horizontal, vertical, slant, curved, and other types of well bore geometries and orientations, and the sand control operation may be applied to a subterranean zone surrounding any portion of the well bore. The well bore 104 can include a casing 110 that is cemented or otherwise secured to the well bore wall. The well bore 104 can be uncased or include uncased sections.

The well is shown with a work string 112 descending from the surface 106 into the well bore 104. A screen 120 is located on the distal end of the working string 112 and is shown with an upper liner hanger packer 122 and a lower open hole packer 124 which define an annulus area 126 between the screen 120 and the formation 102. The working string 112 may include coiled tubing, jointed pipe, and/or other structures that allow fluid to flow into the well bore 104 or formation 102. The working string 112 can include flow control devices, bypass valves, ports, and or other tools or well devices that control a flow of fluid from the interior of the working string 112 into the annulus area between the two packers and screen 120 and the formation 102. For example, the working string 112 may include ports to communicate a fluid 128 into the annulus area between the two packers and the well bore 104 and out into the formation 102 in the annulus area 126.

FIGS. 3*a* through 3*d* illustrate an embodiment of the present disclosure positioned in a well bore 210 extending from a surface location, not shown, to a bottom hole location 212. A casing 214 has been placed in an upper portion of the well 210 and the annulus between the casing 214 and well 210 has been filled with cement 216. Casing 214 may be nominal nine and five/eighth inch steel casing. Below the bottom of the casing 214 or casing shoe 218, the well 210 remains in an open hole, i.e. uncased, condition. In many cases, the casing 214 is placed in an upper portion of well 210 and the open hole portion of the well 210 includes slanted, curved or otherwise deviated portions so that at the bottom hole location 212, the well is horizontal or near horizontal. The present disclosure is suitable for use in wells which are vertical to the bottom hole location 212 or which are slanted or deviated or horizontal over portions of their length.

An assembly 220 according to the present disclosure is shown positioned in the well 210 extending from the casing 214 down to the bottom hole location 212. The assembly 220 has been lowered into position on a work string 222 extending from the surface location of the well 210. A work string for purposes of the present disclosure may be any known pipe having the necessary strength and size to be lowered into and removed from a well 210 to position equipment in the well, flow materials into or from the well for various known operations, etc. A work string 222 may comprise any suitable oilfield tubular element including drill pipe, production tubing, etc. The work string 222 provides a first flow path 224 inside the work string 222 and a second flow path 226 in the annulus between the work string 222 and the casing 214. Fluids may be circulated from the surface down path 224 and back up annulus 226 or reverse circulated down annulus 226 and back up the path 224.

The assembly 220 includes an outer assembly 228 and an inner assembly 230. Inner assembly 230 is connected to the lower end of work string 222 throughout its use in the present disclosure so that it is run into the well 210 on the work string 222 and removed from the well 210 with the work string 222. The inner assembly may therefore be considered part of the work string 222. The outer assembly 228 is mechanically coupled to the inner assembly when the inner assembly 230 is run into the well 210, but, as explained below, is thereafter mechanically coupled to the casing 214 and disconnected from the inner assembly 230, allowing the inner assembly 230 to be repositioned relative to the outer assembly 228 by movements of the work string 222 from the surface location of the well 210.

The outer assembly includes a packer 232, which is shown inflated into sealing contact with the casing 214. Packer 232 may be a combination packer hanger to resist axial movement of the outer assembly 228 in the well 210, or may be only a hanger. In an embodiment, the packer 232 provides a fluid tight seal between outer assembly 228 and the casing 214 as well as mechanically coupling the outer assembly 228 to the casing 214. Below the packer 232 is located an upper cementing port 234 including a sleeve valve 236 allowing the port 234 to be selectively opened or closed. In the run in position, the valve 236 is closed. Below port 234 is located a length of blank pipe 238. Blank pipe 238 is a conventional oil field tubular element, for example steel pipe and may be referred to as a liner because a portion of it may be positioned within the casing 214. In this embodiment, pipe 238 may have a nominal diameter of seven inches and a weight of twenty-three pounds per foot. The length of pipe 238 may be selected based on the distance from the casing shoe 218 to the producing formation or the required position of screens. The pipe 238 will typically pass through curved or deviated portions of the well 210 and may be of considerable length. The various other elements comprising the outer assembly 228 are connected together by various other sections of pipe 238 and/or collars, etc. In some applications, for example in a shallow well, it may be desirable for the pipe 238 to extend a considerable distance up the well 210 and possibly to the surface location and pipe 238 may replace the casing 214.

Below pipe 238 is located a seal bore 240 having an inner sealing surface 242. In this embodiment, the seal bore 240 may comprise a thick wall coupling or length of pipe having a polished inner seal bore surface 242 having a precise inner diameter, e.g. five inches, which is less than the minimum inner diameter of the pipe 238. Alternatively, the seal bore 240, and other seal bores used in the present disclosure, may be a coupling or length of pipe having an inner sealing surface 242 formed of an elastomeric material, e.g. one or more O-rings. As described in more detail below, the inner assembly 230 may carry an outer seal body to seal with the sealing surface 242. If the sealing surface 242 is a polished metal surface, the inner assembly may carry a matching elastomeric seal body. If the sealing surface 242 comprises an elastomeric element, then, the inner assembly may carry a matching polished metal seal body.

Below seal bore 240 is located a lower cementing port 244 including a sleeve valve 246 allowing the port 244 to be selectively opened or closed. In the run in position, the valve 246 is closed. The lower cementing port 244 can also include a spring biased one-way valve, i.e. check valve, which allows fluids to flow out of the port 244 into the annulus 248, but blocks flow of fluids from the annulus 248 into the port 244. Other forms of flow direction biased one-way valves may be used if desired. Such a valve may be omitted if desired and may provide no benefit in some situations, for example if the entire interval to be cemented is horizontal. A second seal bore 250 is located below the port 244.

An external casing packer 252 is located below the second seal bore 250. Below the packer 252 is located a third seal bore 254. Below seal bore 254 is located a valved port 256. The valved port 256 includes a sleeve valve 258, which is typically in its open position when the assembly 220 is run in the well. The valved port 256 can include an outer shroud 260, which directs fluids flowing out of valved port 256 down hole to avoid erosion of the wall of borehole 210. A fourth seal bore 262 is positioned below the valved port 256. Below the seal bore 262 is located a flapper valve 264. While a flapper valve 264 is used in this embodiment, other fluid loss control devices, e.g. a ball valve, may be used if desired.

A screen assembly 266 is located below the flapper valve 264. The screen assembly includes a screen 268 that may be any conventional or premium screen or compliant screen. Other forms of filters, such as slotted pipe or perforated pipe, may be used in place of screen 268 if desired. Above screen 268, a length of blank pipe 270 connects the screen 268 to the upper portions of the outer assembly 228. The pipe 270 may be of smaller diameter than the liner 238, as illustrated. In some embodiments, the pipe 270 and base pipe used in the screen 268 may be of the same diameter as the liner 238. In alternate embodiments, the pipe 270 and base pipe used in the screen 268 may be have a larger diameter as the blank pipe 238.

The inner assembly 230 includes a packer setting tool 272 at its upper end connected to work string 222. The tool 272 is used to set the packer 232 and to release the outer assembly 228 from the work string 222 once the packer 232 is set. The inner assembly includes shifters, e.g. 274, for opening and closing the sleeve valves 236, 246 and 258 as the inner assembly 230 is moved down and up in the well 210. The inner assembly 230 includes a crossover assembly shown generally at 276. The crossover 276 includes a port 278 in fluid communication with the flow path 224 through work string 222. It also includes a flow path 280 in fluid communication with the flow path 226 above packer 232.

On a cylindrical outer surface of crossover 276 is carried a seal unit or seal body 282 extending above and below the port 278. The seal unit 282 may be formed as a separate metal sleeve having a plurality of elastomeric rings on its outer surface. The outer diameter of the elastomeric rings may be slightly greater, e.g. 0.010 to 0.025 inch greater, than the inner diameter of the seal bores 240, 250, 254 and 262. In this embodiment, the seal bores 240, 250, 254 and 262 have polished metal inner surfaces, e.g. 242, with which such elastomeric rings may form fluid tight seals. In an alternative discussed above, the inner surfaces of seal bores 240, 250, 254 and 262 are formed by elastomeric elements such as O-rings. In this alternative, the seal body 282 may comprise only a metal sleeve having a polished outer surface having an outer diameter somewhat larger than the inner diameter of the elastomeric elements forming the inner sealing surfaces, e.g. 242, of the seal bores 240, 250, 254 and 262. In either case, the seal body 282 may form fluid tight seals with the seal bores 240, 250, 254 and 262 at any point along the length of the seal body 282. The seal body 282 has sufficient length above and below the port 278 to form seals with seal bores 240 and 250 at the same time and with seal bores 254 and 262 at the same time.

The lowermost portion of the inner assembly 230 can comprise a wash pipe 284 which extends through flapper 264 and into the screen 268.

In FIGS. 3*a*-3*d*, the assembly 220 is shown in its run in position in well 210 and with the packer 232 set. The packer 232 was set by dropping a ball 286 down the work string 222. Before the ball 286 is dropped, the assembly 220 allows full fluid circulation in the well as the work string 222 and assembly 220 are run into the well. The packer setting tool 272 and pressure in the flow path 224 may be used to set the packer 232. After the packer 232 has been set, the well may be pressure tested by increasing pressure in the annulus 226.

In the run in position shown in FIG. 3, the cross over port 278 is located at the lowermost seal bore 262 below the valved port 256. The seal body 282 contacts the seal bore 262 both above and below port 278, blocking all flow into or out of the port 278. Once the ball 286 is in place, the flow path 224 is isolated from the annulus 248 and annulus 226. After pressure testing the packer 232, the pressure in the annulus 226 may be increased to set packer 252, as illustrated in FIGS. 4-8.

Figure 4:
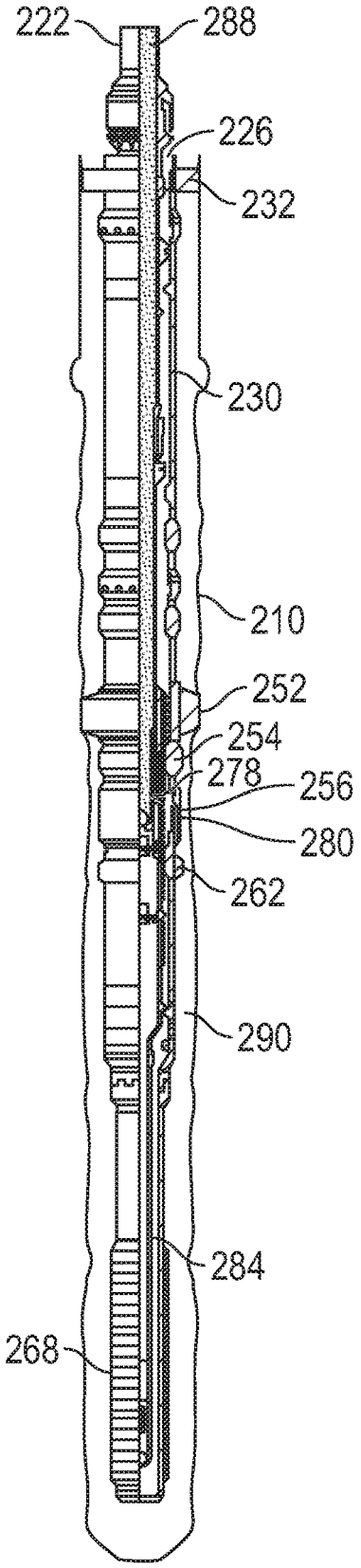
FIG. 4 is an elevation sectional view of FIG. 3, with an inner assembly in a compliant screen activation and/or well treatment/displacement position in accordance with certain embodiments of the present disclosure.

The use of the apparatus of FIGS. 3*a*-3*d* will be described with reference to FIGS. 4-8. After the packers 232 and 252 have been set, as shown in FIG. 4, the inner string 230 may be repositioned for activating the complaint screen and/or treating a portion of the well 210. By lifting the work string 222, the cross over port 278 may be positioned in fluid communication with the valved port 256. This is achieved by positioning seal body 282 to contact the seal bores 254 and 262 above and below crossover port 278 respectively. A treatment fluid 288, such as an acid treatment, may then be flowed from the surface down work string 222 and through port 278 and valved port 256 into the annulus 290 adjacent the screen 268. The displaced liquid flows up the wash pipe 284, through crossover path 280 and into the annulus 226 which can then flow back to the surface location of well 210. Then, by closing a device described in the FIG. 16-20 at the bottom of the compliant screen 268, pressure can be applied from annulus 226 through crossover path 280, down the wash pipe 284 inside the compliant screen 268. The complaint screen 268 will be activated to conform with the borehole geometry.

In the FIG. 4 configuration, the present disclosure may be used to perform pressurized treatments. In some cases it may be desirable to perform a pressurized treatment such as acidizing which requires flowing a fluid down the work string 222 and into the formation surrounding the screen 268. In the FIG. 4 configuration, any treating fluid may be flowed down the work string 222 and pumped into the annulus 290 around the screen 268. By blocking return flow through the annulus 226, pressure may be applied to force the fluid into the formation surrounding the screen 268. The present disclosure provides a convenient system for selectively treating the production zone surrounding the screen 268.

Figure 5:
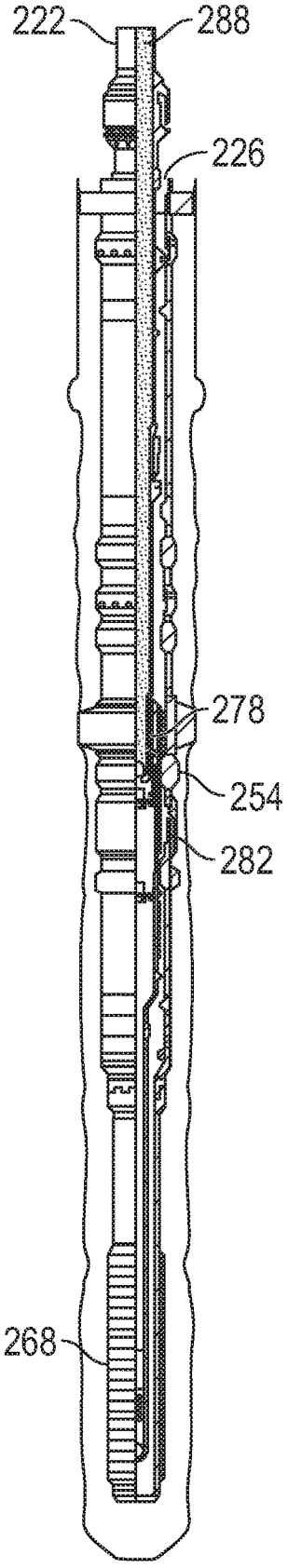
FIG. 5 is an elevation sectional view of FIG. 3, with an inner assembly in a reverse circulation position after compliant screen activation and/or well treatment/displacement in accordance with certain embodiments of the present disclosure.

In FIG. 5, the work string 222 has again been lifted to move the cross over port 278 above the seal bore 254 while leaving the seal body 282 in sealing contact with the seal bore 254 below port 278. In this position, fluid may be reverse circulated down the annulus 226, into crossover port 278 and up the work string 222 to remove any remaining treating fluid from the annulus 226 and work string 222.

Figure 6:
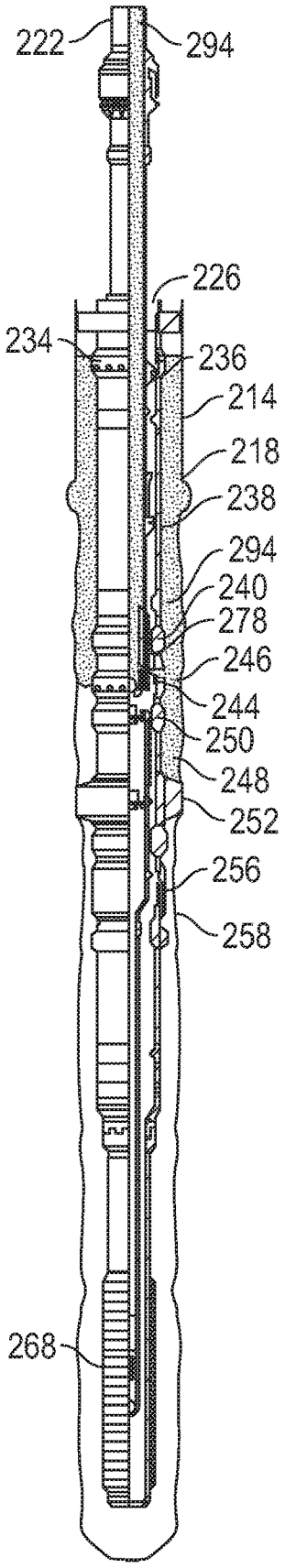
FIG. 6 is an elevation sectional view of FIG. 3, with the inner assembly in a cementing position in accordance with certain embodiments of the present disclosure.

In FIG. 6, the work string 222 has been moved into position for cementing the pipe 238 above the packer 252. The work string 222 has been first lifted to position sleeve shifters above the sleeve valves 236 and 246. During this lifting operation, another shifter can move the sleeve 258 to close the valved port 256 to ensure that no cement can get below the valved port 256 and possibly plug or otherwise harm the screen 268 function. The work string 222 is then lowered to the position shown in FIG. 6. As it is lowered, shifters open the sleeve valves 236 and 246 in the upper and lower cementing ports 234 and 244. In this cementing position, the crossover port 278 is in fluid communication with the lower cementing port 244. The seal body 282 makes sealing contact with the seal bores 240 and 250, above and below the crossover port 278 respectively. In this position, cement 294 may be flowed down the work string 222, through crossover port 278 and lower cementing port 244 into the annulus 248. The cement 294 will then flow up the annulus 248 towards the upper cementing port. In this embodiment, the lower cementing port 244 includes a spring biased check valve. The spring bias may be adjusted to set a minimum pressure at which cement can be pumped through the valve and to provide positive closing of the check valve when pumping has stopped. It may be desirable to pump only enough cement to fill the annulus 248 up to about the location of the casing shoe 218, which is below the port 234. If excess cement is pumped, the excess may flow into the casing 214, through port 234 and back up the annulus 226. In some applications, e.g. shallow wells mentioned above, the blank pipe may extend a considerable distance up the well 210 and may replace casing 214. In such applications, the cementing operation may extend over the length of the pipe 238 and possibly to the surface location of the well and the upper cementing port 234 and packer 232 may be omitted. Reservoir isolation has been provided prior to the cementing operation by means of mechanically closing the valved port 256 that in this embodiment functions as a fluid loss control device positioned above the screen.

Figure 7:
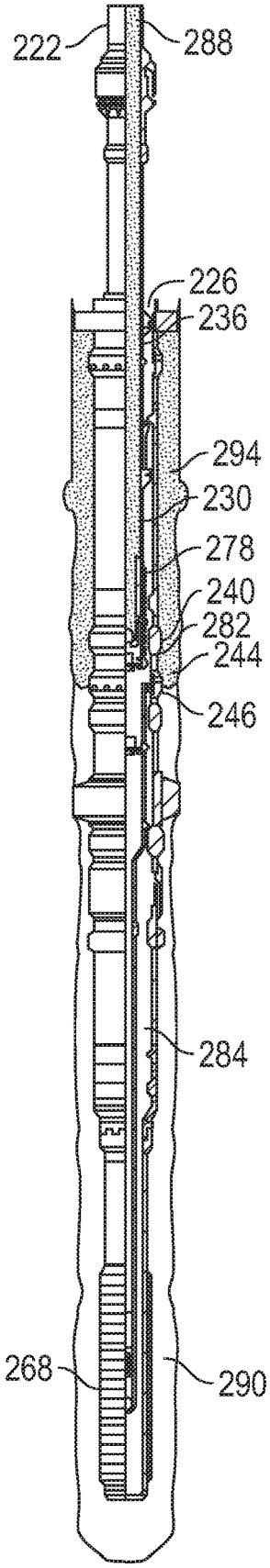
FIG. 7 is an elevation sectional view of FIG. 3, with the inner assembly in a circulation position after cementing in accordance with certain embodiments of the present disclosure.

After pumping of cement 294 is stopped, the work string 222 is again lifted a short distance to the position shown in FIG. 7. In this position, the cross over port 278 is positioned above the seal bore 240 and the seal body 282 below port 278 forms a seal with seal bore 240. Clean fluid may then be circulated down work string 222, through the port 278 and back up the annulus 226 to clean out any excess cement. If desired, the circulation may be reversed. The lower cementing port 244 includes a spring loaded check valve, which closes when the pumping of cement stops. The check valve prevents flow of cement back into the lower cementing port 244 while the work string 222 is being cleaned.

In this embodiment, the cementing operation is performed after the activation of the compliant screen and treatment operation. However, if desired the apparatus may be employed to selectively cement first and then perform the treatment operation and activate the compliant screen. In either case, only one trip into the well is required. In completions with multiple screens as discussed below, it may be desirable to cement around blank pipe sections between screens. In that situation, the cementing and treatment operations may be performed alternately, i.e. compliant screen activation, followed by cementing, followed by treatment, etc.

Figure 8:
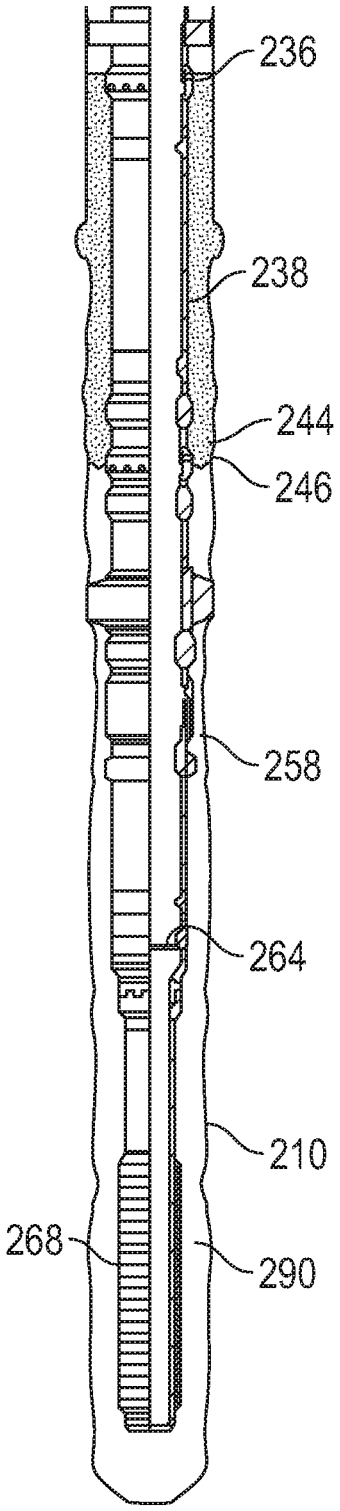
FIG. 8 is an elevation sectional view of FIG. 3, with the inner assembly removed in accordance with certain embodiments of the present disclosure.

After the cement has been placed as shown in FIGS. 6 and 7, and the well and work string have been cleaned out as shown in FIG. 7, the work string 222 and the inner assembly 230 may be removed completely from the well. As the inner assembly 230 is removed, shifters close the valves 236 and 246. As the inner assembly 230 is lifted, the wash pipe 284 is removed from the screen 268 and the flapper valve 264 closes as shown in FIG. 8. If another type of fluid loss control device is used, e.g. a ball valve, a shifter may be used to close the valve. The valve 264 may be a ceramic flapper valve, or other type of fluid loss control device that may be opened or removed for production by methods known in the art. As noted above, the movements of the work string 222 have closed all three of the sleeve valves 236, 246 and 258 so that all ports in the outer assembly are closed and all produced fluids must flow through the screen 268.

In this FIG. 8 configuration, pipe 238 and screen 268 which can be a compliant screen, have been properly installed in an open-hole well 210 with a single trip into the well. The well has been treated, compliant screen 268 has been actuated and placed in a production mode and the blank pipe 238 has been cemented without removing and/or replacing a work string or any part of a work string. The only surface operations required are relatively small vertical repositioning, such as lifting and lowering the work string, the pressuring up or down of the work string, and flowing of appropriate cement and clean out fluids. In certain embodiments other actuation methods can be employed, such as by electrical/accoustic signals or pressure cycle or timer or pressure hydrostatic pressure or activating balls or wiper plugs or any combination of these different activation methods that can shift ports or make other mechanical changes within the work string or within the liner/screen assembly or float shoe assembly.

Figure 9:
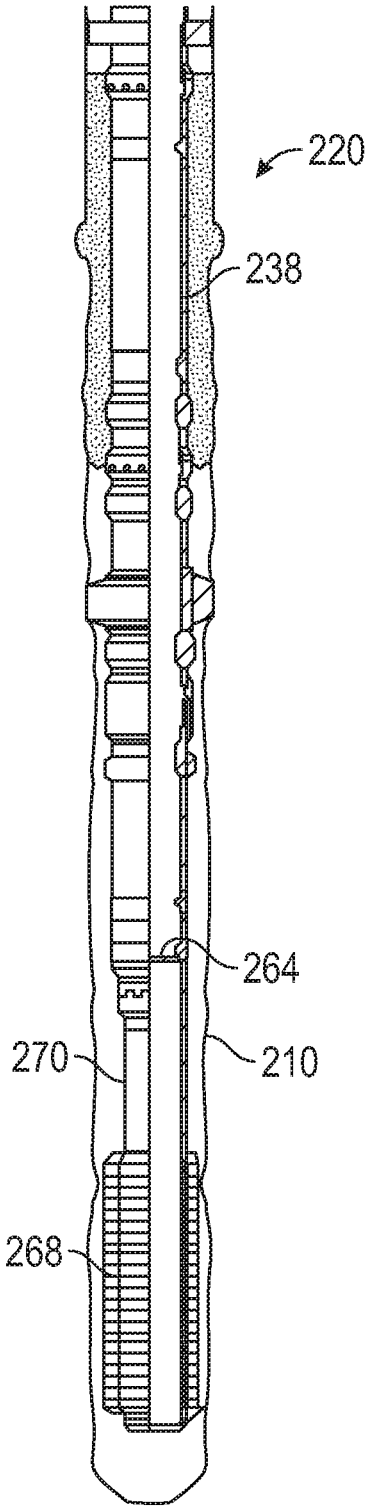
FIG. 9 is an elevation sectional view of FIG. 3, with the inner assembly removed in accordance with certain embodiments of the present disclosure.

In FIG. 9 is shown an embodiment wherein the pipe 238 and compliant screen 268 have been properly installed in an open-hole well 210 with a single trip into the well. The compliant screen 268 has been actuated and placed in a production mode and the blank pipe 238 has been cemented without removing and/or replacing a work string or any part of a work string. In this embodiment the liner 238 and blank pipe 270 can be of the same size. The compliant screen 268 once actuated will be of a larger diameter than that of the liner 238 and blank pipe 270 as shown in FIG. 9.

Figure 10:
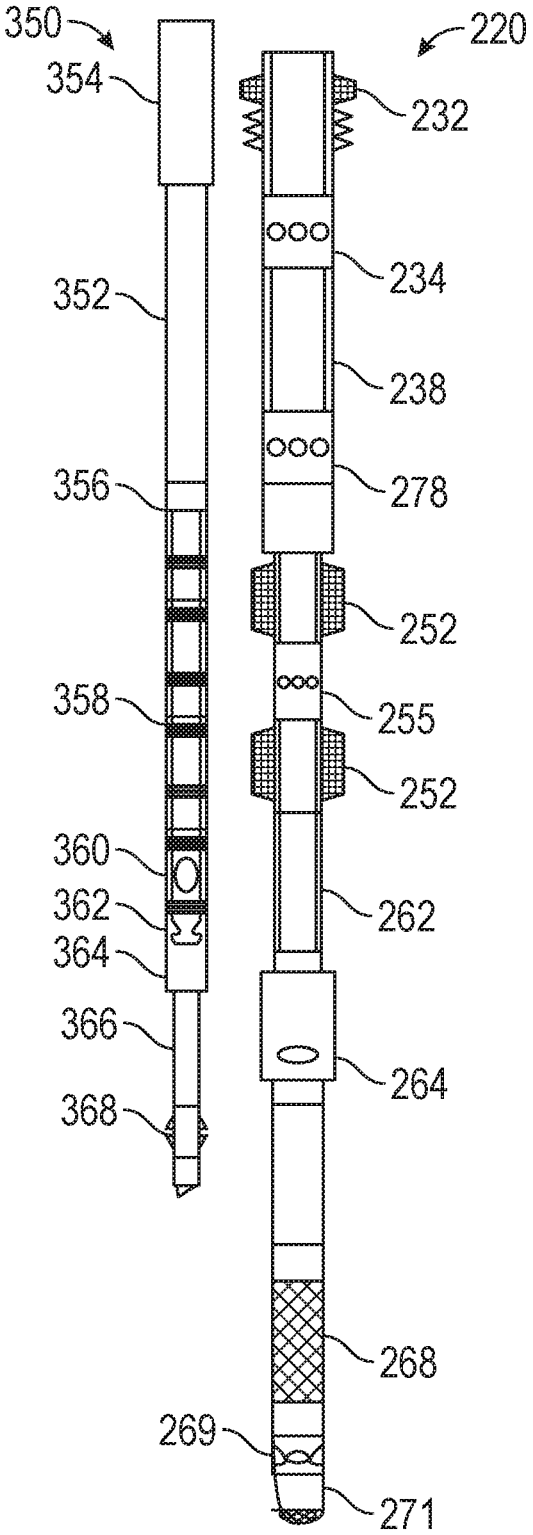
FIG. 10 is an elevation sectional view of a setting tool in accordance with certain embodiments of the present disclosure.

FIG. 10 illustrates a service tool 350 that can be used with the embodiment of the assembly shown in FIG. 9. The service tool can include a base pipe 352 and a liner hanger 354. The service tool 350 further includes one or more circulation ports 356, one or more seal assemblies 358, a cross-over port 360, a ball seat 362, a MCS shifter 364, a reduced diameter extension 366 and a fluid loss device FLD shifter 368. The assembly 220 also includes a downhole shutoff collar 269 and a float shoe assembly 271.

FIGS. 11*a* through 11*f* show cross-sectional views and sectional views of a compliant screen assembly 300 according to an embodiment, at its Run-in state 302, Activation state 304, and Production state 306. At the run-in state 302 the compliant screen 310 is compressed against a base pipe 312 and the assembly has an open flow path 314 therethrough. Fluid flow can be circulated through the assembly 300 if needed to wash down through the wellbore to get to the desired setting depth. The screen assembly 300 can be run in the well with the liner in a single trip on a work string. Pressure can be applied to the work string to set the top hanger packer, release the running tool, set the open hole isolation packers (if hydraulic isolation packer is used) and to put the screen in the activation state 304. Pressure can be bled off and then re-applied to extend the screen 310 to the borehole wall. During the activation state 304 fluid flow through the bottom of the assembly 300 is blocked and hydraulic pressure applied to the assembly 300 can expand the internal chambers 316 and expand the screen 310. In an embodiment, the activated screen 310 can be conformed to the wellbore wall to stabilize and provide support to the wellbore wall. With the screen 310 activated and the pressure bled off, the assembly will convert to the production state 306 to allow fluid production from the formation, through the activated screen 310 and the base pipe 312, through the liner and into the cased wellbore/production tubulars. In an embodiment the compliant screen assembly 300 can be the Endurance Hydraulic Screen® screen assembly available from Halliburton of Houston Tex. Although the Endurance Hydraulic Screen® screen assembly is shown and described herein, other versions of compliant screen systems can be used within the scope of this disclosure.

Figure 13A:
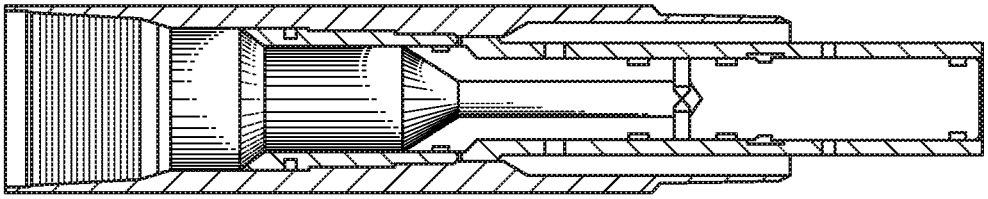
FIGS. 13*a* through 13*b* illustrate cross-sectional views of a downhole shutoff collar assembly according to an embodiment.
Figure 13B:
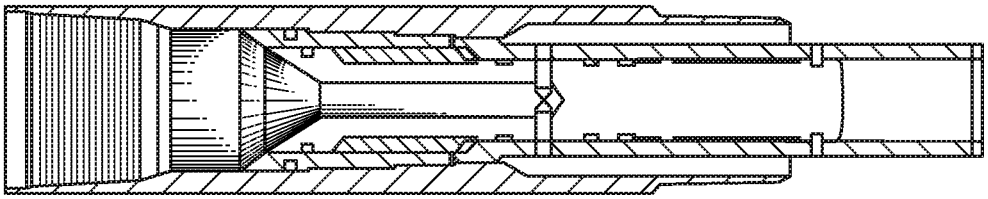
Figure 14:
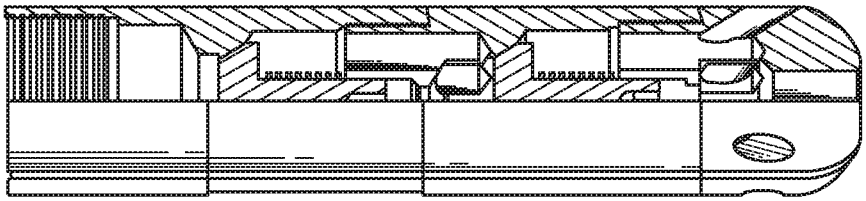
FIG. 14 illustrates an elevation view of a double sideport float shoe assembly according to an embodiment.

To activate the compliant screen assembly 300 the bottom end of the screen assembly 318 will typically need to be isolated. Several options are available to seal off the bottom of the screen assembly, including a simple bull plug. A downhole shutoff collar as shown in FIG. 13 can be used. FIGS. 13*a* and 13*b* illustrate a downhole shutoff collar that can be run at the end of the screen assembly. The downhole shutoff collar provides a fluid flow path for washing down the assembly with the ability to be shut off and seal the end of the assembly so that hydraulic pressure can be applied to activate the screen. The downhole shutoff collar coupled with a double sideport float shoe 271 as shown in FIG. 14 will allow circulation/washdown while running the assembly into the well. A ball can be dropped from the surface to actuate the shut off and isolate the float shoe 271. It will provide a liner/screen assembly pressure seal enabling the setting of the packers and the activation of the compliant screen.

Figure 12A:
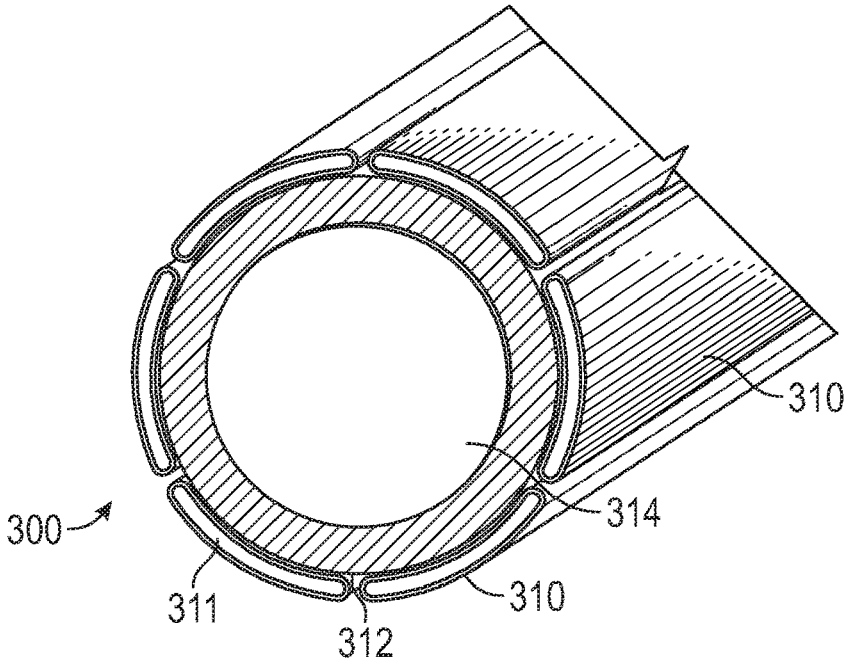
FIGS. 12*a* through 12*d* illustrate cross-sectional views of a compliant screen assembly according to an embodiment.
Figure 12B:
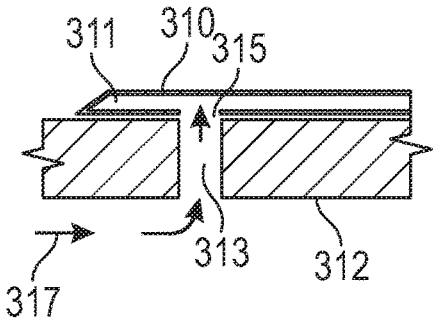
Figure 12C:
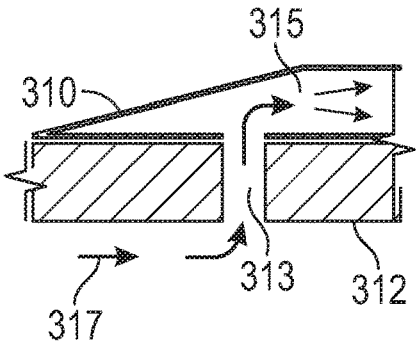
Figure 12D:
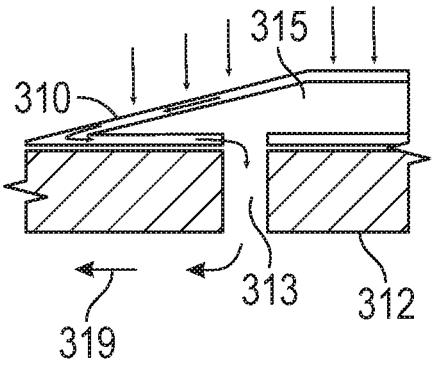

FIGS. 12*a* through 12*d* show cross-sectional views of an expandable screen assembly 300 according to an embodiment. A screen element 310 is shown in FIG. 12A on the exterior of a base pipe 312, the base pipe defining a passageway 314. In FIG. 12B is shown a screen element 310 in a collapsed position, the screen forming a flattened cavity 311. The base pipe 312 contains passageways 313 that allow a fluid flow as shown by arrows 317 to enter and pressure up the cavity 311. With fluid flow 315 the pressure in the cavity 311 increases and expands the screen element 310 as in shown in FIG. 12C. Once the screen 310 is expanded the screen assembly 300 can be put into a production mode as shown in FIG. 12D where fluid flow 315 from the screen 310 flows through the passageways 313 and is flow 319 within the base pipe 312. Many alternate expandable screen assemblies are available and are not limiting as to the application to the disclosure herein.

FIGS. 13*a-b* illustrates an elevation view of a downhole shutoff collar assembly 269 according to an embodiment that can be run at the end of the screen assembly. The shutoff collar assembly 269 provides a fluid flow path for washing down the screen assembly that can be used to facilitate the one trip method disclosed herein.

FIG. 14 illustrates an elevation view of a double sideport float shoe assembly 271 according to an embodiment that can be run at the end of the screen assembly. The float shoe 271 provides a fluid flow path for washing down the screen assembly that can be used to facilitate the one trip method disclosed herein.

Figure 15A:
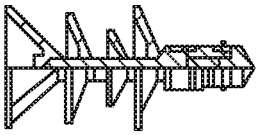
FIGS. 15*a* through 15*b* illustrate an elevation view of a dart and a wiper plug assembly attached to a liner hanger setting tool according to an embodiment.
Figure 15B:
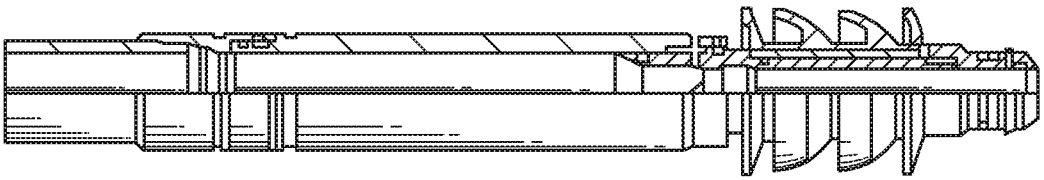

FIGS. 15*a-b* illustrate a dart and a wiper plug attached to a liner hanger setting tool that can be used to facilitate the one trip method. A wiper plug and landing collar could be used to isolate the float shoe assembly 271. A dart can be dropped from the surface to land on the wiper plug assembly in the hanger setting tool. Pressure can be applied to expend the wiper plug assembly to the bottom landing collar as shown in FIG. 15. The float shoe 21 will be isolated enabling pressure to be applied to set the hanger/packers and activate the screen assembly.

Figure 16:
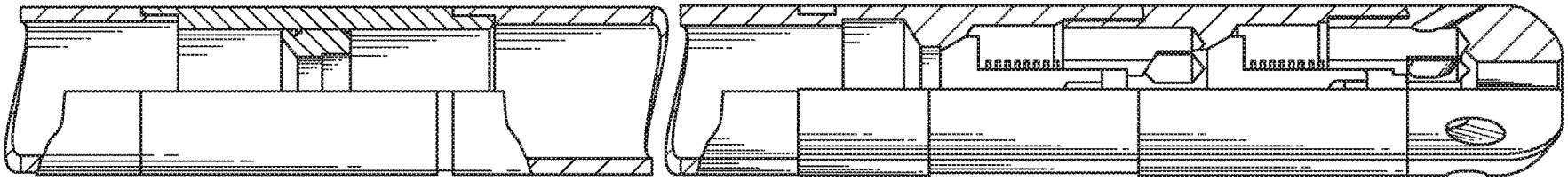
FIG. 16 illustrates an elevation view of a landing collar with a double sideport float shoe assembly according to an embodiment.

FIG. 16 illustrates a landing collar with double sideport float shoe assembly 271 that can be used to facilitate the one trip method disclosed herein.

Figure 17:
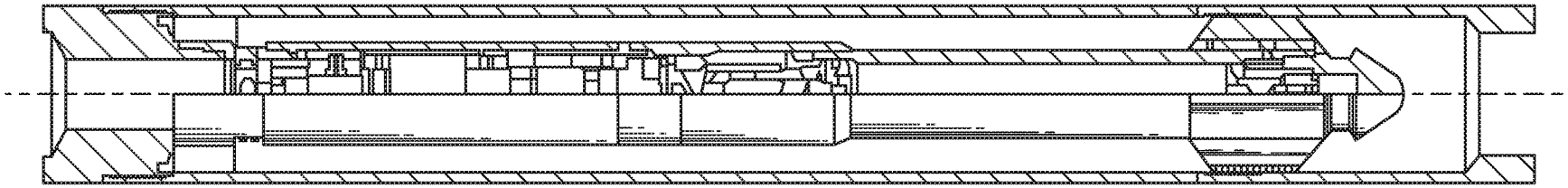
FIG. 17 illustrates an elevation view of an eRED® plug assembly according to an embodiment available from Halliburton of Houston Tex.

FIG. 17 illustrates an elevation view of an eRED plug assembly according to an embodiment available from Halliburton of Houston Tex. The eRED® plug assembly contains an electronic activation element that can be actuated by a signal such as a pressure or temperature change, a timer, or other signal. The eRED® plug combined with a double sideport float shoe 271 can enable the circulation of fluids down through the shoe 271 while running in the hole. The eRED® can then be triggered to close (possible trigger: hydrostatic pressure or timer or applied pressure or combination thereof), isolate the float shoe 271 and allow pressure to be applied to set the hanger/packers and activate the screen.

The above operational procedures are meant to be non-limiting examples of a procedure that could be employed to achieve the desired results of the discloser herein. Alternate procedures may also be employed to likewise achieve the desired results of the discloser herein.

In some cases the liner may not need to be cemented in place, which can be accommodated by the setting of two packers on either end of the liner. These may be pressure activated or chemically activated annular barriers. If the liner requires cementing the work string and service tool can be picked up to open the return flow circulation device and place the service tool into the backflow circulating device above the open hole packer to circulate cement around the liner.

This system provides a sand control solution in a single trip with an intermediate liner while keeping the capability of isolating or/and cementing the liner if desired. This system provides a sand control solution without necessarily having to perform a gravel pack with a considerable reduction of operational risk and cost. Such method will also generally reduce rig time and the related overall cost of well construction and completion.

An embodiment of the present disclosure is a method for placing a compliant screen and liner in a well in a single trip. The method includes running into the well a work string having a liner and a compliant screen assembly and positioning the compliant screen assembly and liner within the well. The method can further include cementing the liner within the well without removing the work string from the well between cementing and positioning the liner and compliant screen assembly. The method can further include actuating a compliant screen assembly and extending an expandable element of the screen assembly without removing the work string from the well between positioning and actuating the screen assembly. The disclosed method enables a larger bore screen to be run in the open hole that otherwise would be limited by the ID of the liner.

An embodiment of the present disclosure is an apparatus for one trip completion of a well that includes a screen assembly carried on a work string, a liner carried on the work string, the compliant screen assembly and liner operable in response to positioning of the work string in the well and/or pressure within the work string without removal of the work string from the well. The apparatus can include cementing equipment carried on the work string, the cementing equipment selectively operable in response to positioning of the work string in the well and/or pressure within the work string without removal of the work string from the well. The apparatus can include compliant screen assembly activation equipment carried on the work string, the activation equipment selectively operable in response to positioning of the work string in the well and/or pressure within the work string to radially extend a screen without removal of the work string from the well.

In another embodiment having multiple screen assemblies, the assemblies may be connected by lengths of blank pipe. It may be desirable to block annular flow outside the lengths of blank pipe by, for example, open hole packers and/or cementing the annuli around such lengths of blank pipe. Cementing of such multiple lengths of pipe between multiple screen assemblies may be accomplished by providing upper and lower cementing ports and seal bores for each length of pipe which is to be cemented. The inner assembly may then be positioned to selectively open cementing valves and flow cement into the various annuli between the blank pipe lengths and the well bore wall.

An embodiment of the present disclosure is a method for completing a well in a single trip, that includes running into the well a liner, a liner hanger, at least one open-hole packer, a compliant screen assembly and float shoe on a work string. The method includes positioning the liner, liner hanger, at least one open-hole packer, compliant screen assembly and float shoe within the well while washing down through the float shoe, setting the liner hanger and the at least one open-hole packer and placing the compliant screen assembly in production mode without removing the work string from the well between setting the liner hanger and at least one open-hole packer and placing the screen assembly in production mode.

The method can include isolating an annulus between the liner and the well by cementing the liner within the well without removing the work string from the well between cementing the liner and positioning the compliant screen assembly. The method can optionally include isolating an annulus between the liner and the well by annular barrier device without removing the work string from the well between isolating the annulus between the liner and the well and positioning the compliant screen assembly. Alternate embodiments include actuating the compliant screen assembly and extending an expandable element of the screen assembly without removing the work string from the well between positioning and actuating the screen assembly. In an embodiment the expanded screen element conforms to the wall of the well, thus providing formation stabilization as well as filtering effects. They can further include setting a portion of the liner within a cased portion of the well.

An alternate embodiment includes running into the well a work string comprising a plurality of liner sections and screen sections and positioning the plurality of compliant screen sections and liner sections within the well. The individual annulus between each liner section and wellbore can be isolated either by an annular barrier device or by cementing the liner within the well without removing the work string from the well between cementing each liner section and positioning the plurality of compliant screen sections.

An alternate embodiment is a single trip completion of a well in an open hole that includes running a work string into the well, using the work string to position a liner, a liner hanger, at least one open-hole packer, a compliant screen assembly and a float shoe while circulating through the float shoe. Once positioned the completion includes setting the liner hanger and at least one open-hole packer, actuating the compliant screen assembly and placing the compliant screen assembly in production mode. Then the at least a portion of the work string is repositioned to activate a cementing functionality of the work string. The workstring is used to isolate an annulus between the liner and the well without removing the work string from the well between the cementing operation and placing the compliant screen assembly in production mode. The annulus between the liner and well can be isolated by cementing the liner within the well or by setting one or more annular barrier device. The method can further include actuating the compliant screen assembly and extending an expandable element of the compliant screen assembly without removing the work string from the well between positioning and actuating the compliant screen assembly. The liner can be set within a cased portion of the well.

Alternate embodiments can include running into the well a work string comprising a plurality of liner sections and compliant screen sections and positioning the plurality of compliant screen sections and liner sections within the well, which can further include isolating the individual annulus between each liner section and wellbore either by annular barrier device or cementing the liner within the well without removing the work string from the well between cementing each liner section and positioning the plurality of compliant screen sections.

A further embodiment is an apparatus for one trip completion of a well that includes a compliant screen assembly, liner and cementing equipment carried on a work string. The compliant screen assembly, liner and cementing equipment selectively operable in response to positioning of portions of the work string in the well and/or pressure within the work string without removal of the work string from the well. The apparatus can include compliant screen assembly activation equipment carried on the work string, the activation equipment selectively operable in response to positioning of the work string in the well and/or pressure within the work string to radially extend a screen without removal of the work string from the well. The apparatus can include a plurality of liner sections and compliant screen sections, and can optionally include sufficient ports and sleeves for isolating each individual annulus between each liner section and wellbore either by annular barrier device or cementing the liner within the well without removing the work string from the well between cementing each liner section and positioning the plurality of compliant screen sections.

The operations of the steps are described with reference to the systems/apparatus shown described herein. However, it should be understood that the operations of the steps could be performed by embodiments of systems and apparatus other than those discussed herein and are not meant to be limiting. Embodiments discussed herein could perform alternate operations different than those discussed but achieving substantially similar results.

The text above describes one or more specific embodiments of a broader disclosure. The disclosure also is carried out in a variety of alternate embodiments and thus is not limited to those described here. The foregoing description of an embodiment of the disclosure has been presented for the purposes of illustration and description. It is not intended to be exhaustive or to limit the disclosure to the precise form disclosed. Many modifications and variations are possible in light of the above teaching. It is intended that the scope of the disclosure be limited not by this detailed description, but rather by the claims appended hereto.

What is claimed is:

1. A method for completing a well in a single trip, comprising:

running into an annulus of a wellbore, a liner, a liner hanger, at least one open-hole packer, a sleeve valve assembly, an inner assembly having a crossover assembly associated therewith, and a compliant screen assembly on a work string in a run-in state in which fluid flows through the work string and into the well;

positioning the liner, the liner hanger, the at least one open-hole packer, the sleeve valve assembly, and the compliant screen assembly within the well, wherein the compliant screen assembly includes an expandable internal chamber, a wash pipe received within the compliant screen assembly, and a screen that overlays the expandable internal chamber;

setting the liner hanger and the at least one open-hole packer;

placing the compliant screen assembly in an activation state by blocking fluid flow through the bottom of the compliant screen assembly such that hydraulic pressure is applied through the annulus, through a crossover path of the crossover assembly, down the wash pipe into the expandable internal chamber within the screen of the compliant screen assembly, causing the expandable internal chamber to expand, and causing the screen of the compliant screen assembly to conform to an inner wall of the wellbore; and placing the compliant screen assembly in a production state, subsequent to the activation state, by changing the flow path by removing the wash pipe, and opening or removing a fluid loss control device located between the compliant screen assembly and the sleeve valve assembly.

2. The method of claim 1, wherein placing the compliant screen assembly in the production state includes bleeding off pressure within the work string.

3. The method of claim 2, wherein placing the compliant screen assembly in the activation state includes bleeding off pressure within the work string and then re-applying the pressure.

4. The method of claim 1, wherein placing the compliant screen assembly in an activation state extends the screen radially from the compliant screen assembly to conform with the inner wall of the wellbore and placing the compliant screen assembly in the production state.

5. The method of claim 1, further comprising: circulating fluid through a float shoe located below the compliant screen assembly while positioning the compliant screen assembly within the well and shutting off the flow path.

6. The method of claim 1, further comprising: performing an acid treatment by lifting the inner assembly to position a crossover port of the inner assembly in fluid communication with a valved port of the sleeve valve assembly prior to cementing of the liner.

7. The method of claim 1, further comprising: isolating an annulus between the liner and the well by cementing the liner within the well without removing the work string from the well between cementing the liner and positioning the compliant screen assembly.

8. The method of claim 1, further comprising: isolating an annulus between the liner and the well by setting an annular barrier device without removing the work string from the well between isolating the annulus between the liner and the well and positioning the compliant screen assembly.

9. The method of claim 1, wherein running further comprises: running a work string into the wellbore, wherein the work string comprises a plurality of liner sections and at least one compliant screen section and positioning the plurality of screen sections and liner sections within the wellbore.

10. The method of claim 9, further comprising: isolating the annulus between each liner section and wellbore either by an annular barrier device or cementing the liner within the well without removing the work string from the well between isolating each liner section and positioning the plurality of screen sections.

11. A method for single trip completion of a well in an open hole, comprising:

running a work string into an annulus of a wellbore with a compliant screen assembly in a run-in state in which fluid can be circulated through the work string and into the well and out a float shoe;

using the work string to position, within the wellbore, a liner, a liner hanger, at least one open-hole packer, a sleeve valve assembly, an inner assembly having a crossover assembly, an outer assembly, a compliant screen assembly and a float shoe, while circulating the fluid through the float shoe, wherein the compliant screen assembly comprises an expandable internal chamber, a wash pipe received within the compliant screen assembly, and a screen that overlays the expandable internal chamber;

setting the liner hanger and the at least one open-hole packer;

placing the compliant screen assembly in an activation state by blocking fluid flow through the work string and out the float shoe such that hydraulic pressure is applied through the annulus, through a crossover path of the crossover assembly, down the wash pipe and into the expandable internal chamber within the screen of the compliant screen assembly, causing the expandable internal chamber to expand and causing the screen of the compliant screen assembly to conform to an inner wall of the wellbore, without removing the work string from the wellbore; and repositioning at least a portion of the inner assembly to activate a cementing functionality of the work string to change the flow path by shifting the sleeve valve assembly to close a valve port of the sleeve valve assembly and open a cementing port within the outer assembly.

12. The method of claim 11, wherein isolating an annulus of the wellbore between the liner and the wellbore is achieved by cementing the liner within the wellbore.

13. The method of claim 11, wherein isolating an annulus between the liner and the wellbore is achieved by setting one or more annular barrier device.

14. The method of claim 11, further comprising placing the compliant screen assembly in a production state, and wherein placing the compliant screen assembly in an activation state, repositioning the work string to activate a cementing functionality, and placing the compliant screen assembly in the production state are performed without removing the work string from the well.

15. The method of claim 11, further comprising: setting a portion of the liner within a cased portion of the well.

16. The method of claim 11, further comprising performing an acid treatment by lifting the inner assembly to position a crossover port of the inner assembly in fluid communication with a valved port of the sleeve valve assembly.

17. The method of claim 11, further comprising: running the work string into the well, wherein the work string comprises: a plurality of liner sections and compliant screen assemblies and positioning the plurality of compliant screen assemblies and liner sections within the well.

18. The method of claim 17, further comprising: actuating the compliant screen assemblies and isolating the annulus between each liner section and wellbore either by an annular barrier device or cementing the liner within the well without removing the work string from the well.

19. Apparatus for one trip completion of a well, comprising:

a liner;

a work string;

an inner assembly coupled to the work string and having a crossover assembly and a crossover port and including cementing ports and sleeve valves configured to be engageable with a service tool coupled to the work string to be selectively opened or closed;

a sleeve valve assembly having a valved port that opens into an annulus of a wellbore and is alignable with the crossover port by a shifting action of the inner assembly that provides a flow path through the inner assembly and the valved port and into the annulus of the wellbore, the sleeve valve assembly and the inner assembly being sequentially operable by a work string without removing the work string from the well;

a compliant screen assembly, liner and cementing equipment carried on a work string, wherein the compliant screen assembly includes an expandable internal chamber, a wash pipe received within the compliant screen assembly, and a screen that overlays the expandable internal chamber; and a plug that is positionable in the bottom of the compliant screen assembly and configured to block a fluid flow through a bottom end of the compliant screen assembly such that when hydraulic pressure is applied through the annulus of the wellbore and through the crossover path, fluid is directed into the expandable chamber causing the expandable chamber to expand the screen to conform to a wall of the wellbore.

20. The apparatus of claim 19, further comprising: a downhole shutoff collar coupled to the compliant screen assembly and configured to be shut off to seal the end of the compliant screen assembly and manipulate the compliant screen assembly via the work string.

* * * * *